US010849441B1

(12) United States Patent
Rapue

(10) Patent No.: US 10,849,441 B1
(45) Date of Patent: Dec. 1, 2020

(54) STORAGE APPARATUS

(71) Applicant: John Rapue, Olathe, KS (US)

(72) Inventor: John Rapue, Olathe, KS (US)

( * ) Notice: Subject to any disclaimer, the term of this patent is extended or adjusted under 35 U.S.C. 154(b) by 0 days.

(21) Appl. No.: 16/517,634

(22) Filed: Jul. 21, 2019

(51) Int. Cl.
*A47F 5/00* (2006.01)
*A47F 7/28* (2006.01)
*A47B 49/00* (2006.01)

(52) U.S. Cl.
CPC ..... *A47F 5/0087* (2013.01); *A47B 49/002* (2013.01); *A47F 7/28* (2013.01)

(58) Field of Classification Search
CPC ..... A47B 49/002; A47F 5/0087; A47F 7/28
See application file for complete search history.

(56) References Cited

U.S. PATENT DOCUMENTS 828,926 A * 8/1906 Clare ..... A47F 5/03 211/131.2
919,725 A * 4/1909 Huffman ..... A47F 5/03 211/131.2
949,393 A * 2/1910 Crego ..... A47F 5/03 211/164
1,116,616 A * 11/1914 Paddock ..... A47B 11/00 108/95
1,281,105 A * 10/1918 Unger ..... A47F 5/03 211/164
1,552,290 A * 9/1925 Fowler ..... A47F 5/03 211/131.2
3,674,155 A 7/1972 Kessler
3,732,829 A * 5/1973 Bech ..... A47B 49/002 108/95
3,784,024 A * 1/1974 Kristy ..... A47B 49/002 211/131.2
D258,206 S * 2/1981 Bourke ..... 47/39
D264,604 S * 5/1982 Sussman ..... D11/143
4,767,167 A * 8/1988 Jeffries ..... A47B 49/002 211/121
4,852,748 A 8/1989 Burgess et al.
5,039,180 A * 8/1991 Lemons ..... A47B 49/002 312/267
D332,186 S * 1/1993 Bellaflores ..... D21/829
5,248,049 A * 9/1993 Murphy, Sr. ..... B25H 3/06 211/131.2
5,370,247 A 12/1994 Handleman
D471,326 S * 3/2003 Weiser ..... D11/143
(Continued)

FOREIGN PATENT DOCUMENTS

DE 29511975 U1 * 9/1995 ..... A47B 49/002
DE 19512210 C1 * 5/1996 ..... A47B 49/002
(Continued)

*Primary Examiner* — Stanton L Krycinski

(57) ABSTRACT

An illustrated view of an exemplary storage apparatus for holding items is presented. The storage apparatus is useful for providing a secure, easy to access and efficient storage facility for items such as hardware, jewelry, fishing tackle, knick-knacks, etc. and can be adapted to hold larger items. The storage apparatus is useful to organize and to control clutter in a given area. The storage apparatus has a bracket for attaching to a surface. The storage device has a gear assembly coupled to the bracket. The gear assembly is useful for rotating a plurality of shelves which has containers for storing items.

8 Claims, 1 Drawing Sheet

(56) References Cited

U.S. PATENT DOCUMENTS

| | | | | |
|---|---|---|---|---|
| 6,557,491 | B1 * | 5/2003 | Weiser | A01G 9/022 119/57.8 |
| 7,028,636 | B2 * | 4/2006 | Weiser | A01K 39/014 119/57.8 |
| D542,583 | S | 5/2007 | Watchowski et al. | |
| 7,699,181 | B2 | 4/2010 | Torro | |
| 7,985,043 | B2 * | 7/2011 | Cook | B60P 1/02 414/331.14 |
| 8,950,599 | B2 * | 2/2015 | Wilder | A47B 49/00 211/77 |
| 8,955,699 | B2 * | 2/2015 | Wilder | A47B 49/002 211/77 |
| 9,095,210 | B1 * | 8/2015 | Alspaugh | A47B 49/002 |
| 2005/0194336 | A1 * | 9/2005 | Wu | A47B 49/002 211/164 |
| 2013/0180939 | A1 | 7/2013 | Wilder | |
| 2018/0263368 | A1 * | 9/2018 | Galles | A01G 22/00 |

FOREIGN PATENT DOCUMENTS

| | | | | |
|---|---|---|---|---|
| DE | 19604847 | A1 * | 8/1997 | A47B 49/002 |
| DE | 29710466 | U1 * | 8/1997 | A47B 49/002 |

* cited by examiner

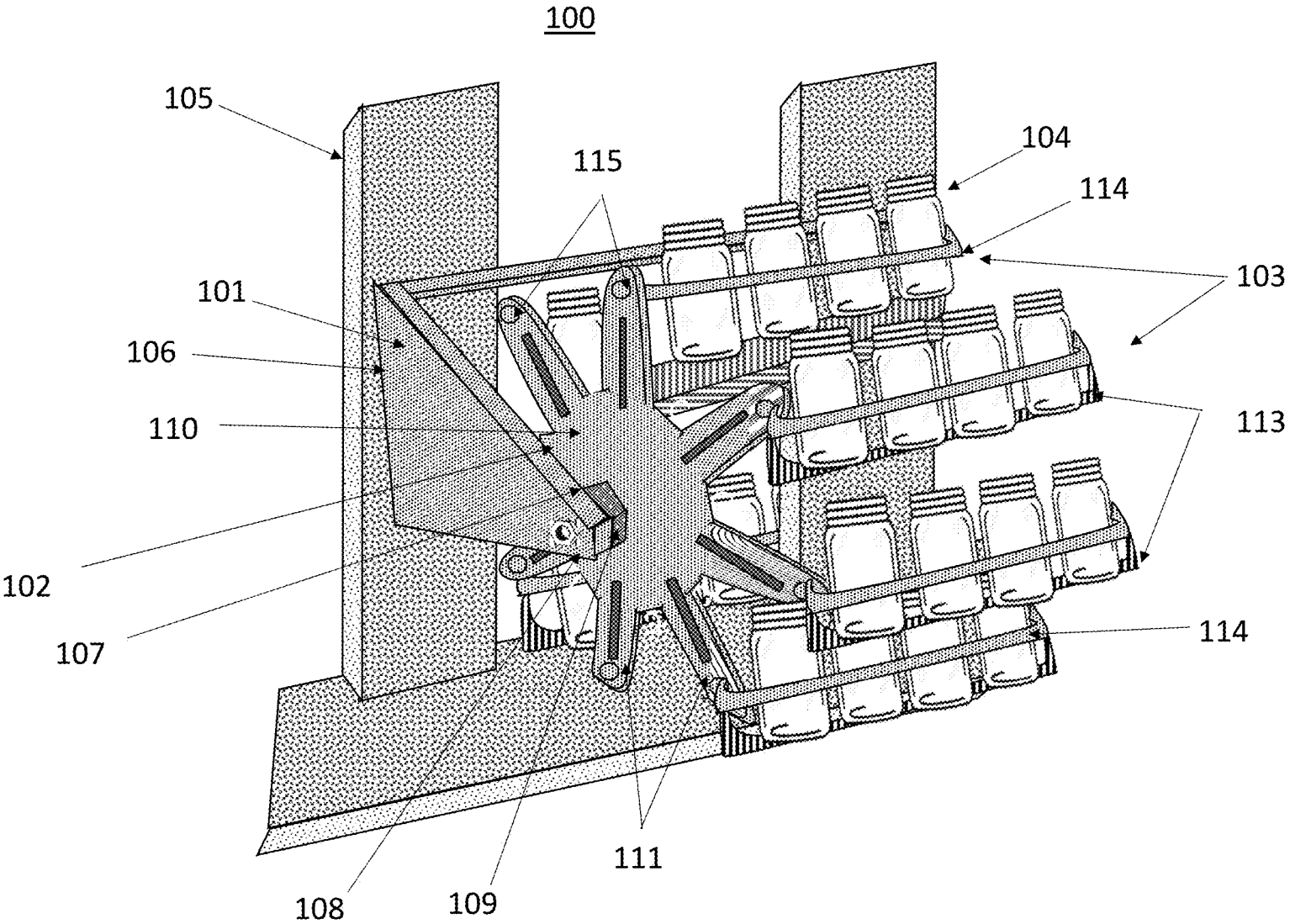
100
103
113
114
114
104
115
111
109
108
105
101
106
110
102
107

STORAGE APPARATUS

FIELD OF THE INVENTION

This invention relates to storage of items. More particularly, it relates to efficient storage devices.

BACKGROUND

A shelf is typically a flat horizontal plane which is used in a home, business, store, or elsewhere to hold items that are being displayed, stored, or offered for sale. It is raised off the ground and usually anchored/supported on its shorter length sides by brackets. It can also be held up by columns or pillars. A shelf is also known as a counter, ledge, mantel, or rack. Tables designed to be placed against a wall, possibly mounted, are known as console tables, and are similar to individual shelves.

A shelf can be attached to a wall or other vertical surface, be suspended from a ceiling, be a part of a free-standing frame unit, or it can be part of a piece of furniture such as a cabinet, bookcase, entertainment center, some headboards, and so on. Usually two to six shelves make up a unit, each shelf being attached perpendicularly to the vertical or diagonal supports and positioned parallel one above the other. Free-standing shelves can be accessible from either one or both longer length sides. A shelf with hidden internal brackets is termed a floating shelf. A shelf or case designed to hold books is a bookshelf.

The length of the shelf is based upon the space limitations of its siting and the amount of weight which it will be expected to hold. The vertical distance between the shelves is based upon the space limitations of the unit's siting and the height of the objects; adjustable shelving systems allow the vertical distance to be altered. The unit can be fixed or be some form of mobile shelving. The most heavy-duty shelving is pallet racking. In a store, the front edge of the shelf under the object(s) held might be used to display the name, product number, pricing, and other information about the object(s).

Shelves take up space and can be difficult to determine where a particular item is stored. In light of the foregoing, there is a need for an apparatus to store items without having unnecessary large footprint and being efficient to find items stored.

BRIEF DESCRIPTION OF THE DRAWINGS

FIG. 1 is an illustrated view of an exemplary storage apparatus.

DETAILED DESCRIPTION

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated view of an exemplary storage device 100 for holding items is presented. The storage device 100 is useful for providing a secure, easy to access and efficient storage facility for items such as hardware, jewelry, fishing tackle, knick-knacks, etc. and can be adapted to hold larger items. The storage device 100 is useful to organize and to control clutter in a given area.

The storage device 100 has a bracket 101, a gear assembly 102, a plurality of shelves 103 and a plurality of containers 104. The storage device 100 is preferably made of a hard-plastic material, however other materials are hereby contemplated, including, but not limited to, steel, aluminum, poly-vinyl chloride (PVC), etc. The storage device 100 is rotatable such that items can be selected easily and efficiently.

A first end 106 of the bracket 101 is useful in coupling the storage apparatus 100 to a mounting surface 105 by one or more first coupling devices (not shown). The mounting surface 105 is preferably a wall, but other surfaces are hereby contemplated, including, but not limited to, wall studs, a stand, a tree, etc. The one or more first coupling devices are preferably lag bolts, however other devices are hereby contemplated, including, but not limited to, screws, quick release latches, nails, etc.

A second end 108 of the gear assembly 102 is movably coupled to a first end 107 of the bracket 101 by a second coupling device 109. The second coupling device 109 is preferably a gear, however other devices are hereby contemplated, including, but not limited to, Thompson coupling, Bush pin type flange coupling, etc.

The gear assembly 102 has a plate 110 and a plurality of arms 111. The plurality of arms 111 are coupled or extend from the plate 110. The plurality of arms 111 are preferably equal distance apart. The gear assembly 102 is preferably round in shape.

The plurality of shelves 113 of the storage apparatus 100 for storing items. The items are preferably small items, however larger items are further contemplated by this application. The small items may be, but not limited to, nuts, bolts, sewing items, fishing gear, etc.

Each of the plurality of shelves 103 is removably coupled to each of the plurality of arms 111 by a third coupling 115. The third coupling 115 is preferably a set screw, however other couplings are hereby contemplated, including, but not limited to, a quick release latch, a hinge, etc. Each of the plurality of shelves 103 has a floor 113 and bar 114. The floor 113 is useful for sitting the plurality of containers 104. The bar 114 prevents the plurality of containers 104 from being dislodged from the shelves 103.

Once the storage apparatus 100 is erected, a user would place the items into the plurality of containers 104. The plurality of containers 104 are then placed on the shelves 103. Optionally and/or additionally, the plurality of containers 104 may be placed on the shelves 103 prior to placing items into the plurality of containers 104.

Next, the user turns the gear assembly 102 until the item being searched for is visible and accessible. The user then removes one or more of the items from the container 104.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A storage apparatus for holding items, the apparatus consisting of:

a bracket, the bracket being coupled to a surface by a first coupling, wherein the first coupling being a lag bolt, the lag bolt being coupled into the surface;

a gear assembly, the gear assembly having a plate and one or more arms, wherein the gear assembly being coupled to the bracket by a second coupling;

a plurality of shelves, each of the plurality of shelves having a floor and a bar, wherein each of the plurality of shelves being removably coupled to a different one of the plurality of arms by a third coupling; and a plurality of containers, the containers being for holding items, wherein the plurality of shelves being configured to hold the plurality of containers.

2. The apparatus of claim 1, wherein the storage apparatus being made of a hard-plastic material.

3. The apparatus of claim 1, wherein the gear assembly being rotatable.

4. The apparatus of claim 1, wherein the surface being a wall.

5. The apparatus of claim 1, wherein the second coupling being a gear.

6. The apparatus of claim 1, wherein the third coupling being a set-screw.

7. The apparatus of claim 1, wherein the items being one of nuts, bolts, sewing items and fishing gear.

8. A storage apparatus for holding items, the apparatus consisting of:

a bracket, the bracket being coupled to a surface by a first coupling, wherein the first coupling being a lag bolt, the lag bolt being coupled into the surface, wherein the surface being a wall;

a gear assembly, the gear assembly having a plate and one or more arms, wherein the gear assembly being coupled to the bracket by a second coupling, wherein the second coupling being a gear, wherein the gear assembly being rotatable;

a plurality of shelves, each of the plurality of shelves having a floor and a bar, wherein each of the plurality of shelves being removably coupled to a different one of the plurality of arms by a third coupling, wherein the third coupling being a set-screw; and a plurality of containers, the containers being for holding items, wherein the plurality of shelves being configured to hold the plurality of containers, wherein the items being one of nuts, bolts, sewing items and fishing gear, and wherein the storage apparatus being made of a hard-plastic material.

* * * * *